United States Patent [19]

Madsen

[11] 4,286,726

[45] Sep. 1, 1981

[54] FLOATING DECK LEG BOOTS

[75] Inventor: Gary J. Madsen, Spring Lake, Mich.

[73] Assignees: Gary Madsen; Ronald Vargo, both of Spring Lake, Mich.

[21] Appl. No.: 81,981

[22] Filed: Oct. 4, 1979

[51] Int. Cl.[3] ..... B65D 88/40; B65D 88/34

[52] U.S. Cl. ..... 220/220; 220/222; 248/188.9; 248/632

[58] Field of Search ..... 248/188.9, 188.8, 560, 248/632, 634, 635; 220/216, 217, 218, 219, 220, 221, 222; 4/185 R, 185 S, 190, 290

[56] References Cited

U.S. PATENT DOCUMENTS

| | | | |
|---|---|---|---|
| 1,664,521 | 4/1928 | Mayette | 248/188.9 |
| 1,892,481 | 12/1932 | Carlson | 4/290 |
| 2,036,372 | 4/1936 | Stough | 220/222 |
| 2,737,310 | 3/1956 | Ulm | 220/222 |
| 2,835,508 | 5/1958 | Wood et al. | 248/188.9 |

*Primary Examiner*—James T. McCall

*Attorney, Agent, or Firm*—Blanchard, Flynn, Thiel, Boutell & Tanis

[57] ABSTRACT

To protect the floor of a liquid containing tank from marring by the lower end of hollow supporting legs used with a floating cover for said liquid, there are provided resilient pad means for fixing to the lower end of such legs whereby to provide scratch-free contact of said legs with such floor when said cover is in a lowered position. Said pads have drainage means therein to permit liquid to drain out of said legs when the tank is emptied for cleaning.

6 Claims, 4 Drawing Figures

FLOATING DECK LEG BOOTS

FIELD OF THE INVENTION

The invention relates to storage tanks for liquids such as petroleum products and it relates particularly to means for protecting the floor of such tanks from damage by the lower end of the legs associated with the floating cover used therein when such cover is in a lowered position.

BACKGROUND OF THE INVENTION

Storage tanks for liquids, such as petroleum products, utilizing an internal floating cover for such liquids have been known for a long period of time and, subject to minor variations in construction, have long been reasonably well standardized. Included within such standardized construction is a floating cover for the liquid product stored therein which cover floats on top of such liquid and rises and falls with the upper surface thereof. Such cover is normally provided with a plurality of legs affixed thereto in any of several well-known ways. Said legs extend below such cover for engaging the floor of the tank when the liquid is either absent therefrom or is sufficiently low as not to lift said cover a minimum distance from said floor.

Said floors have long been made from the same material as that from which the tank is made, which may be either steel or aluminum, and which for corrosion resistant purposes along with the remaining interior of the tank, is then coated with a vinyl, epoxy, or other appropriate plastics which are inert to the product, as a petroleum product, to be received into said tank. When said cover is in a lowermost position, said legs rest on said bottom under such conditions that they often scratch same or even gouge it sufficiently, particularly after repeated operations, as to permit the liquid product to contact the metal bottom, corrode same and permit leakage. Inasmuch as such leakage must be prevented regardless of cost for well-known reasons both economic and environmental, the present practice is to drain the tank periodically and recoat the bottom thereof, thus requiring the recoating of the entire bottom to effect repair of only scattered wear and/or scratch or gouge marks.

This procedure is reasonably effective and has gone into widespread use. However, it is expensive and takes a given tank out of use for longer than required for mere cleaning.

This situation has caused severe maintenance problems in connection with such tanks and it has long been highly desirable to provide a simple but effective means for preventing such scratching or gouging of the bottom of such tanks.

DETAILED DESCRIPTION

Figure 1:
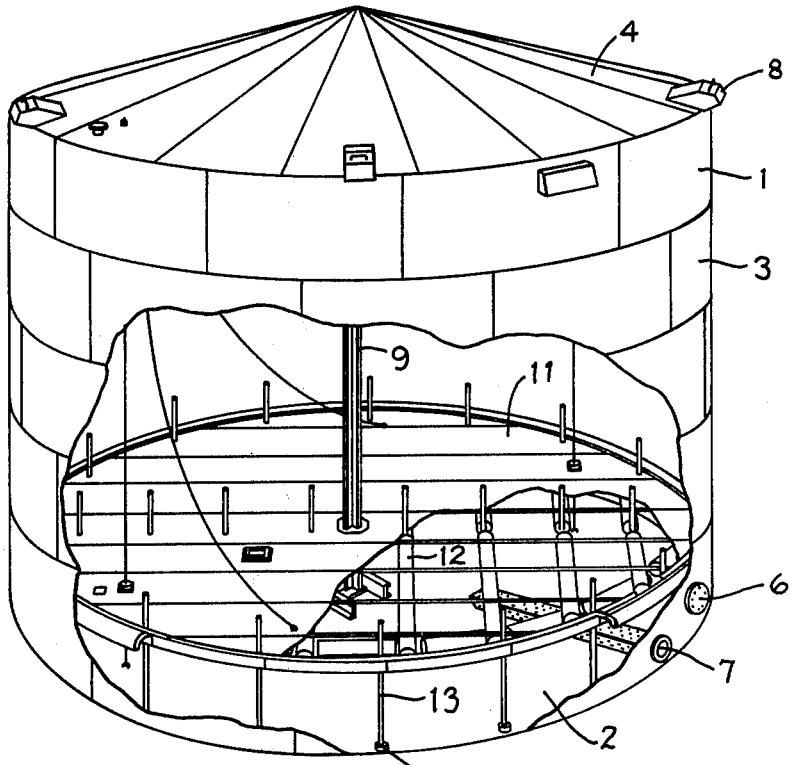
FIG. 1 is a partially broken somewhat schematic view of a storage tank for petroleum products having the floating cover with which said invention is utilized.

Referring first to FIG. 1 for proper understanding of the problem toward which the invention is directed, there is shown a conventional tank 1 for the reception and storage of liquid products, such as petroleum products. Said tank has the usual bottom 2, side walls 3 and top 4 and is fitted with a conventional manway 6, fill inlet 7 and ventilators 8. A central post 9 is provided for guiding the hereinafter-mentioned cover upwardly and downwardly as said tank is filled with, or emptied of, said liquid. The entire bottom and side walls of the tank are conventionally plastic coated for corrosion resisting purposes.

The cover 11 fits snugly within said tank, is provided with any convenient float means of which one is indicated at 12 for causing said cover to float on the surface of the liquid and is further provided with a plurality of legs 13, usually hollow for weight-saving purposes, by which said cover is prevented from dropping all of the way to the bottom when said liquid is drained, or substantially drained, from the tank.

However, as above outlined, when this happens the lower ends of said legs often gouge the vinyl or epoxy coating on the bottom of said tank, thus requiring either immediate repair or resulting in early failure of the tank.

According to the invention, there are provided pads P made from resilient material which can be applied to the lower ends of said legs and will when the float drops contact the bottom of the tank and prevent the legs from gouging same.

Said pads P comprise a generally cylindrical body portion 16 which may if desired be downwardly tapered, as at 17, to provide a shape somewhat resembling an inverted truncated cone. An opening 18 is provided within said body part concentric therewith and opening upwardly thereof. A washer 19 of any pressure resisting material, such as aluminum, is positioned at the end of said opening. A drain hole 21 is provided through the remainder of said body part 16 and through an opening 22 in the washer in registry therewith. A cross-slot 23 connects the drain hole 21 to the exterior of the pad. A pin 24 extends through suitably registered openings in the leg 13 and body part 16 for holding the pad firmly in place.

Similar pads are placed on all of the other legs associated with said float.

It will thus be seen that said pad will prevent the metal of said legs from gouging the bottom of said storage tank whether same is of metal or whether same is of metal coated with vinyl epoxy or other plastics in a conventional manner. Any liquid within the tank which may have entered into the internal opening 26 of the leg 13 will drain out through the openings 22 and 21 into the cross-slot 23 and from thence back into the tank. The cross-slot 23 insures that such drainage will continue even after the pad P is resting on the bottom of the tank.

Figure 2:
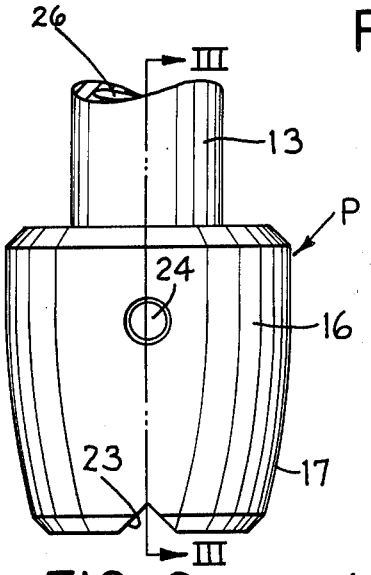
FIG. 2 is an enlarged view of the end of a leg with the invention applied thereto.
Figure 3:
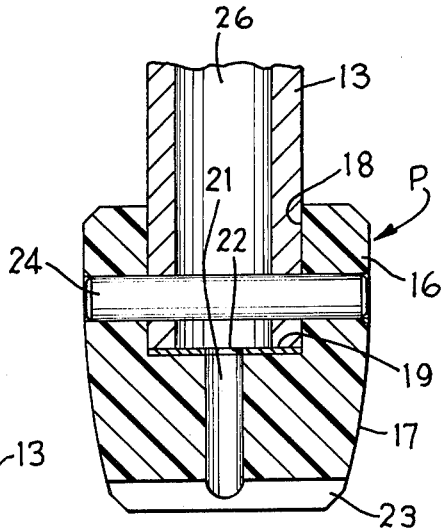
FIG. 3 is a section taken on the line III—III of FIG. 3.
Figure 4:
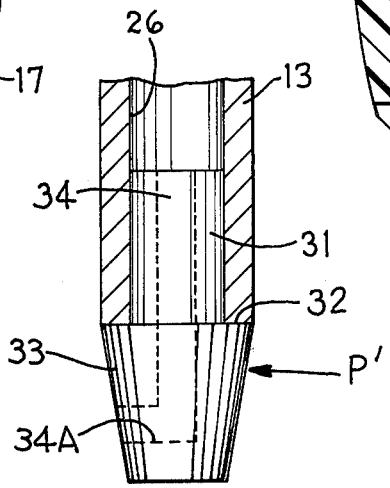
FIG. 4 is a section similar to FIG. 3 showing a modification.

FIG. 4 shows a modification wherein the pad P′ is arranged for projecting into the opening 26 of the leg 13 instead of embracing same externally as it does in the embodiments of FIGS. 2 and 3. In this modification, the pad P′ has a body portion 31 fitting snugly into the opening 26 and having a step 32 connecting said body portion to the upper end of a tapered portion 33. Said step 32 provides an abutment for the lower end of the leg 13 and opening 34 extends through the entirety of the body portion 31, partway through the tapered portion 33 and then turns radially at 34A to open through the side of the tapered portion 33. Alternatively if desired (not shown) said passageway 34 may extend through the bottom of the pad P' into a cross-slot in the same manner as illustrated for the embodiment of FIGS. 2 and 3.

In the embodiment of FIG. 4, the pad P' protects the bottom of the tank from contact with the lower end of the leg 13 and yet permits drainage through the opening 34 of any liquid which may during normal use of the tank have entered into the interior 26 of said leg 13.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a liquid containing tank having a bottom, generally vertical side walls and a floating cover for cooperating with said bottom and side walls to enclose liquid contained within said tank, said cover having a plurality of downwardly extending legs for contacting said bottom and holding said cover spaced from said bottom when liquid is at least substantially withdrawn from said tank, the improvement comprising:

means defining a lengthwise opening in each said leg;

a resilient pad fixed to the bottom of each of said legs for engaging the bottom of said tank and preventing direct contact between said bottom and the lower end of each of said legs whereby to eliminate scratching or gouging of said bottom by the lower end of said legs, each said pad having a vertical opening communicating at its upper end with the lengthwise opening in a said leg to which it is attached, and each said pad having a transverse opening communicating between the vertical opening near its lower end and the exterior of said pad, whereby said liquid can seek its level within said legs.

2. The device of claim 1, wherein each said pad is of generally circular cross section and has a leg receiving opening substantially concentric therewith extending thereinto for receiving the lower end of one of said legs, said vertical opening communicating with the interior of the lower end of said leg.

3. The device of claim 1, wherein said transverse opening is a groove in the bottom of said pad intersecting the lower end of said vertical opening.

4. The device of claim 1 including also a pin extending diametrically through said pad and said leg for holding said pad firmly in position on said leg.

5. In a liquid containing tank having a bottom, generally vertical side walls and a floating cover for cooperating with said bottom and side walls to enclose liquid contained within said tank, said cover having a plurality of downwardly extending legs for contacting said bottom and holding said cover spaced from said bottom when liquid is at least substantially withdrawn from said tank, the improvement comprising:

a resilient pad fixed to the bottom of each of said legs for engaging the bottom of said tank and preventing direct contact between said bottom and the lower end of each of said legs whereby to eliminate scratching or gouging of said bottom by the lower end of said legs, said pad comprising an upper body portion extending into the opening within said leg and a lower portion defining with said body portion a step for engaging the end of a leg into which said body portion is inserted and a drain opening extending generally lengthwise through said pad and providing communication from the interior of said leg to the exterior of said pad at a point below the end of said leg when said pad is in its normal position of operation.

6. The device of claim 6, wherein said drain opening has a vertical portion which is generally concentric with the vertical axis of said pad from the upper end thereof to a point below the lower end of said leg when same is in its normal position of operation and has a transverse portion which extends laterally from said point to the exterior of said pad.

* * * * *